United States Patent [19]

Wincent

[11] Patent Number: 4,507,003

[45] Date of Patent: Mar. 26, 1985

[54] PAPER TAPE FEED AND DRIVE MECHANISM

[75] Inventor: Karl T. Wincent, Tiverton, R.I.

[73] Assignee: Litton Systems, Inc., Fall River, Mass.

[21] Appl. No.: 498,400

[22] Filed: May 26, 1983

[51] Int. Cl.[3] ..... B41J 13/02

[52] U.S. Cl. ..... 400/636; 400/593; 400/584

[58] Field of Search ..... 400/584, 585, 586, 588, 400/636, 656, 593, 592, 594, 621

[56] References Cited

U.S. PATENT DOCUMENTS

| | | | |
|---|---|---|---|
| 579,676 | 3/1897 | Graham | 400/584 X |
| 3,151,546 | 10/1964 | Clary et al. | 400/621 X |
| 3,421,612 | 1/1969 | Pitt | 400/584 |
| 3,822,773 | 7/1974 | Van Arnam et al. | 400/621 X |
| 3,837,461 | 9/1974 | Waibel | 400/636 X |
| 4,417,517 | 11/1983 | Matsuda et al. | 400/584 X |

FOREIGN PATENT DOCUMENTS

| | | | |
|---|---|---|---|
| 704952 | 3/1954 | United Kingdom | 400/636 |

*Primary Examiner*—Edgar S. Burr
*Assistant Examiner*—John A. Weresh
*Attorney, Agent, or Firm*—Brian L. Ribando

[57] ABSTRACT

A paper feed and drive mechanism for use in a high speed printer comprises a pair of arms which may be selectively positioned in a first lowered position, or in a second raised position. When the arms are in the lowered position, a line of contact is formed between a pressure roll and a drive roll and a narrow printing gap is formed between the platen and the inked ribbon. Spring means bias the pressure roll onto the drive roll and clips mounted on the arms hold the arms in the lowered position against the bias. Allowing the arms to raise to a second position in response to the spring bias creates a gap between the pressure roll and the drive roll and a wide non-printable gap between the platen and the inked ribbon. Additionally, a narrow tear bar slot formed between a fixed saw tooth tear bar and a backing plated attached to the arms opens to form a wide space when the arms are raised. The wide space eliminates the necessity to thread the paper tape through the narrow tear bar slot.

3 Claims, 2 Drawing Figures

PAPER TAPE FEED AND DRIVE MECHANISM

BACKGROUND OF THE INVENTION

The invention relates to a paper tape feed and drive mechanism used in a high speed printer in point-of-sale applications.

High speed printers, particularly those associated with recording retail sales, are normally required to record transactions in more than one form. In some instances, three records are made for each sale, a printed customer receipt, a journal record for the store, and a separate slip imprinted for charge transactions.

The time taken to print this data in these forms, though on an absolute basis can be quite fast, on a relative basis can materially effect queue times in these days of mass merchandising. Another printer characteristic which contributes to overall queue time is the replenishing of paper tapes for customer receipt and journal records. A printer which is so constructed as to simplify the tape replacement process is both faster and less likely to create frustration in the counter clerks.

It is therefore an object of this invention to provide a drive for a plurality of paper tapes fed from continuous rolls, such as are found in cash registers for issuing receipts and keeping a journal record.

It is further an object of the invention to provide such a drive which can be easily reloaded after exhausting a paper roll by eliminating the need to meticulously thread the paper through narrow slots or through a nip formed at the drive roller pinch line.

DESCRIPTION OF THE PREFERRED EMBODIMENT

Figure 1:
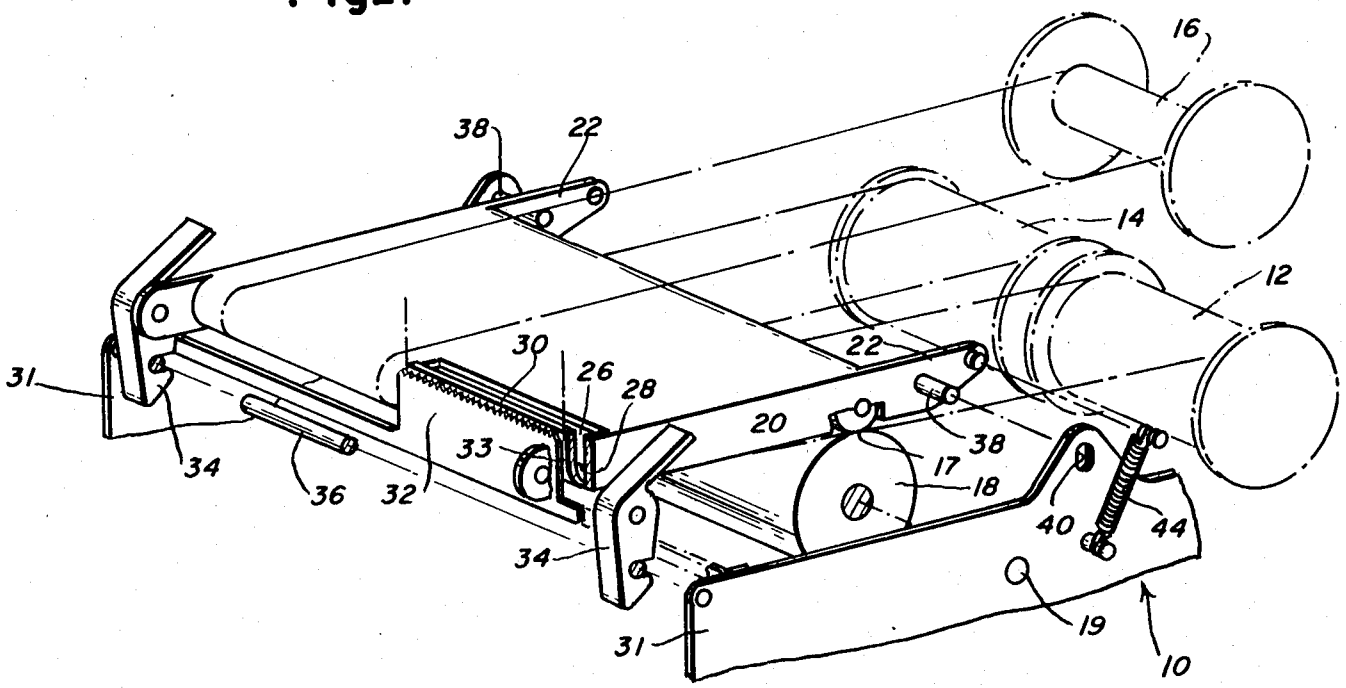
FIG. 1 is a perspective view of a paper feed and drive mechanism for advancing a plurality of strips of paper from continuous rolls.

Referring to FIG. 1, there is shown a feed and drive mechanism generally referred to by the reference numeral 10. The mechanism supports paper supply rolls 12 and 14. The supply roll 12 holds strip paper for receipts, as in a cash register. The supply roll 14 holds strip paper for a permanent journal record, as in a cash register, and is fed to a take-up reel 16 for permanent storage. Paper from each of these rolls 12 and 14 is fed to the line of contact or nip 17 formed between a drive roll 18 rotatively supported by pivots 19 and a pressure roll 20. The drive roll 18 and the pressure roll 20 may be each a single unit for the entire drive mechanism or longitudinally split so as to provide a separate drive and pressure roll for each of the paper tapes 12 and 14. When certain information which is printed on the receipt paper is omitted from the journal roll, such as the store name and address, it becomes desirable to drive each tape separately, accounting for the fewer lines appearing on the journal tape. By splitting the drive roll 18 and pressure roll 20 and providing each drive roll segment with its separate advancing linkage (not shown for either a single or split roll pair), the amount of paper feed per transaction is optimized.

In prior art devices, the drive roll and pressure roll, the platen, and the inked ribbon are all secured or guided relative to the frame at fixed locations. Inserting a new paper tape into such machines requires guiding the paper tape into the nip between the drive roll and pressure roll and causing the rolls to rotate in order to draw the paper tape therethrough. In addition, a narrow gap of typically 0.020 inch exists between the inked ribbon and the platen through which the paper tape must be threaded. The task is further complicated by the fact that the 0.020 inch gap is often situated in the machine mechanism so as to be obscured from normal view.

According to the invention the pressure rolls 20 are carried on arms 22 which are mounted to the machine by pivots 38. A printing platen 26 is also attached to the arms 22 and provides a flat print area 28 on its lower surface. A saw tooth tear bar 32 is attached to the frame 31 and a backing plate 30 attached to the platen 26 is spaced from the tear bar 32 to form a tear bar slot 33.

The pivots 38 by which the arms 22 are rotatively attached to the machine frame are located in elongated slots 40. The arms 22 are biased in a raised position by tension springs 44. In this raised position, the pressure roll 20 is spaced from the drive roll 18 to create a gap therebetween, the print area 28 of the platen is spaced from the inked ribbon 46, and the backing plate 30 is removed from behind the tear bar 32. Hold-down clips 34 are mounted on the ends of the arm 22 and are selectively engagable with a hold-down rod 36 to position the pressure roll 20 and the printing platen 26 in operative position, and to create the tear bar slot 33.

MODE OF OPERATION OF THE PREFERRED EMBODIMENT

Figure 2:
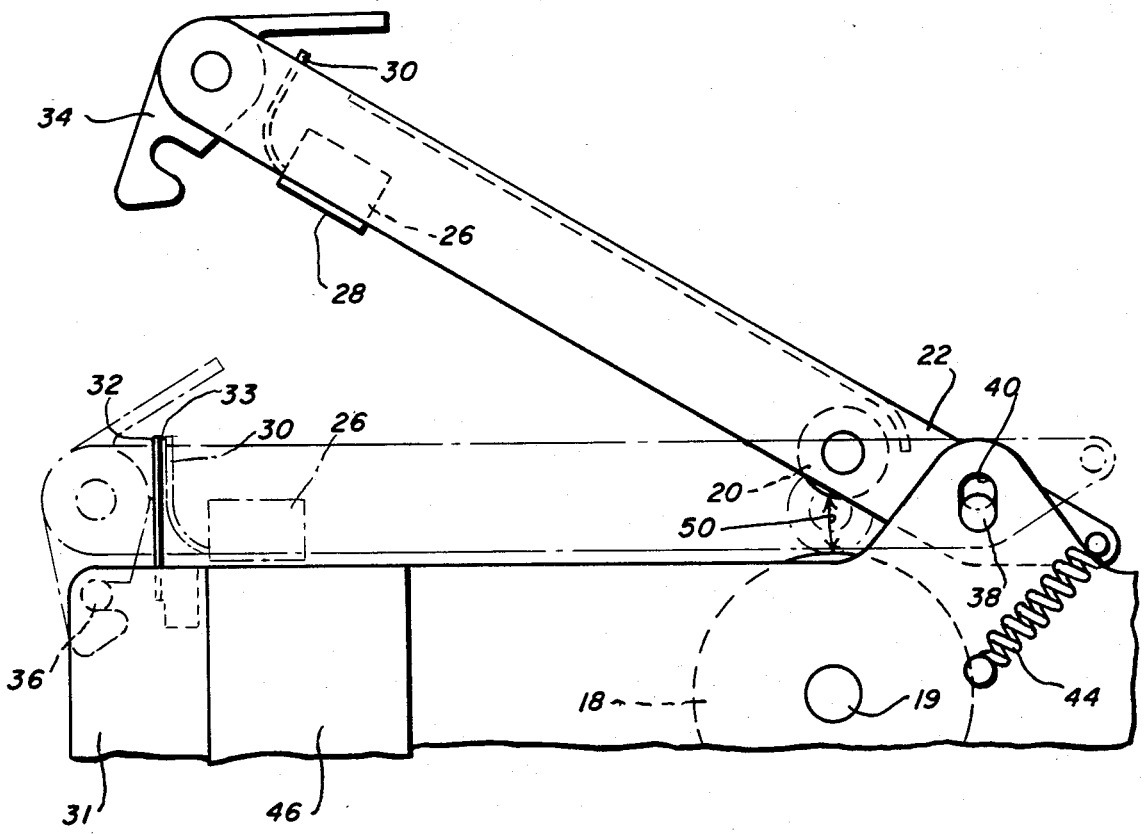
FIG. 2 is a side view of the feed and drive mechanism of FIG. 1.

As best seen in FIG. 2, when the hold-down clips 34 disengage the rods 36, the tension springs 44 draw the pivots 38 to the bottom of the elongated slots 40 and rotate the arms 22 and the platen 26 to a raised position. In this position, the pressure roll 20 is spaced from the drive roll 18 creating a large opening through which the paper tape is easily passed. A large non-printable gap 50 is formed between the inked ribbon 46 and the print area 28 of the printing platen 26. This gap allows the paper tape to be placed on top of the inked ribbon and separately threaded into position relative to the saw-toothed cutter 32, or the top surface of the platen 26, as the case may be. The tear bar slot 33 is opened up whereby the paper tape may be laid across the top of the tear bar 32. As the arms 22 are lowered, the paper from the rolls 12 and 14 is pinched between the drive roll 18 and the pressure roll 20. After initial contact of these rolls 18 and 20 with the paper, continued rotation of the arms 22 shifts the pivot point of the arms 22 from the pivots 38 to the line of contact of the rollers and the paper and causes the pivots 38 to rise in the elongated slots 40. Both rotational movements of the arms 22, about pivots 38 and about the line of contact of the rolls 18 and 20 increase the tension applied by spring 44 until the clips 34 engage the rod 36. The spring tension provides the frictional force between the drive roll 18 and the pressure roll 20 to advance the paper as the drive roll 18 is rotated by a drive mechanism. The lowered arms 22 also position the print area 28 of the platen the required 0.020 inch from the inked ribbon 46 so that printing may take place, and the placement of the backing plate 30 behind the tear bar 32 creates the tear bar slot 33 in which the paper tape is automatically captured.

What is claimed is:

1. A paper feed and drive mechanism for use in a high speed printer in which a matrix printing element is used to print alpha-numeric information through an inked ribbon onto a paper tape comprising:

a machine frame, a drive roll mounted on said frame, a pair of arms having first and second ends which may be selectively positioned in a first lowered position, or in a second raised position, and mounted adjacent said first ends to said frame by pivot posts, a pressure roll mounted on said pair of arms near said first ends, a platen having a printing surface mounted on said pair of arms near said second ends, spring means attached to said first ends of said arms and to said machine frame, clips mounted on said second ends of said arms for holding said arms in the first lowered position against the bias of said spring means, a line of contact formed between the pressure roll and the drive roll when said arms are in said first lowered position, said line of contact forming a nip through which said paper tape is driven, a narrow printing gap formed between said printing surface and said inked ribbon when said arms are in said lowered position, release means on said clips for releasing said clips and thereby allowing said arms to raise to the second position in response to said spring bias, whereby a gap is formed between said drive roll and pressure roll a wide non-printable gap formed between said printing surface and said inked ribbon when said arms are in said raised position, whereby said paper tape may be replenished without threading said tape through either said nip or said narrow printing gap.

2. The mechanism of claim 1 further comprising:

a tear bar mounted to said machine frame, a backing plate attached to said platen, a narrow tear bar slot formed between the tear bar and said backing plate when said arms are in said first lowered position, and a wide space formed between the tear bar and said backing plate when said arms are in said second raised position, whereby said paper tape may be replenished without threading said tape through said narrow tear bar slot.

3. A paper feed and drive mechanism for use in a high speed printer in which a matrix printing element is used to print alpha-numeric information through an inked ribbon onto a paper tape comprising:

a machine frame, a drive roll and a tear bar mounted on said frame, a pair of arms which may be selectively positioned in a first lowered position, or in a second raised position, and mounted to said frame by pivot posts, elongated slots in said frame for receiving said pivot posts, whereby with said arms in the second raised position said arms pivot in said elongated slots, and with said arms in said first position, said pivot posts raise in the elongated slots, and said arms pivot about a line of contact formed between the pressure roll and the drive roll, a pressure roll mounted on said pair of arms, a platen having a printing surface mounted on said pair of arms, a backing plate attached to said platen, spring means attached to one end of said arms, clips mounted on the opposite end of said arms for holding said arms in the first lowered position against the bias of said spring means, a nip formed by the line of contact through which said paper tape is driven, release means on said clips for allowing said arms to raise to the second position in response to said spring bias, whereby a gap is formed between said drive roll and pressure roll allowing said paper tape to be replenished without threading said tape through said nip, a narrow printing gap formed between said printing surface and said inked ribbon when said arms are in said lowered position, a wide non-printable gap formed between said printing surface and said inked ribbon when said arms are in said raised position, whereby said paper tape may be replenished without threading said tape through said narrow printing gap, a narrow tear bar slot formed between the tear bar and said backing plate when said arms are in said first lowered position, and a wide space formed between the tear bar and said backing plate when said arms are in said second raised position, whereby said paper tape may be replenished without threading said tape through said narrow tear bar slot.

* * * * *